US006237644B1

(12) United States Patent
Hay et al.

(10) Patent No.: US 6,237,644 B1
(45) Date of Patent: May 29, 2001

(54) TISSUE FORMING FABRICS

(76) Inventors: Stewart Lister Hay, 12 Heapworth Ave., Ramsbottom, Bury BL0 9EH (GB); James Loy Brewster, 159 Private Rd. 1139, Waskom, TX (US) 75692; Jeffrey Bruce Herman, 42 Derwen Rd., Bala Cynwyd, PA (US) 10994; Jan Strom, Ringvagen 4, SE-610 40 Gusum (SE)

( * ) Notice: Subject to any disclaimer, the term of this patent is extended or adjusted under 35 U.S.C. 154(b) by 0 days.

(21) Appl. No.: 09/333,227

(22) Filed: Jun. 15, 1999

Related U.S. Application Data

(60) Provisional application No. 60/098,913, filed on Sep. 1, 1998.

(51) Int. Cl.[7] ..... D03D 1/04
(52) U.S. Cl. ..... 139/383 A; 139/383 R
(58) Field of Search ..... 139/383 R, 383 A

(56) References Cited

U.S. PATENT DOCUMENTS 2,865,409 * 12/1958 Asten ..... 139/426
3,214,330 * 10/1965 Wicker et al. ..... 162/358
4,022,596 * 5/1977 Pedersen ..... 55/528
4,239,065 * 12/1980 Trokhan ..... 139/383 A
4,281,688 * 8/1981 Kelly et al. ..... 139/383 A
4,356,844 * 11/1982 Thompson ..... 139/383 A
4,759,391 * 7/1988 Waldvogel et al. ..... 139/383 A
5,429,686 * 7/1995 Chiu et al. ..... 139/383 A
5,713,397 * 2/1998 Quigley ..... 139/383 A

* cited by examiner

*Primary Examiner*—John J. Calvert
*Assistant Examiner*—Robert H. Muromoto, Jr.
(74) *Attorney, Agent, or Firm*—Caesar, Rivise, Bernstein, Cohen & Pokotilow, Ltd.

(57) ABSTRACT

A fabric employed in a web forming apparatus to form a patterned fibrous web includes at least one layer of yarns oriented in first and second directions and being woven to provide a lattice that separates a plurality of systematically distributed woven areas of a predetermined configuration that is defined by the pattern of the continuous lattice and with the systematically distributed woven areas including at least three yarns oriented in each of the first and second directions.

38 Claims, 11 Drawing Sheets

FIG.1
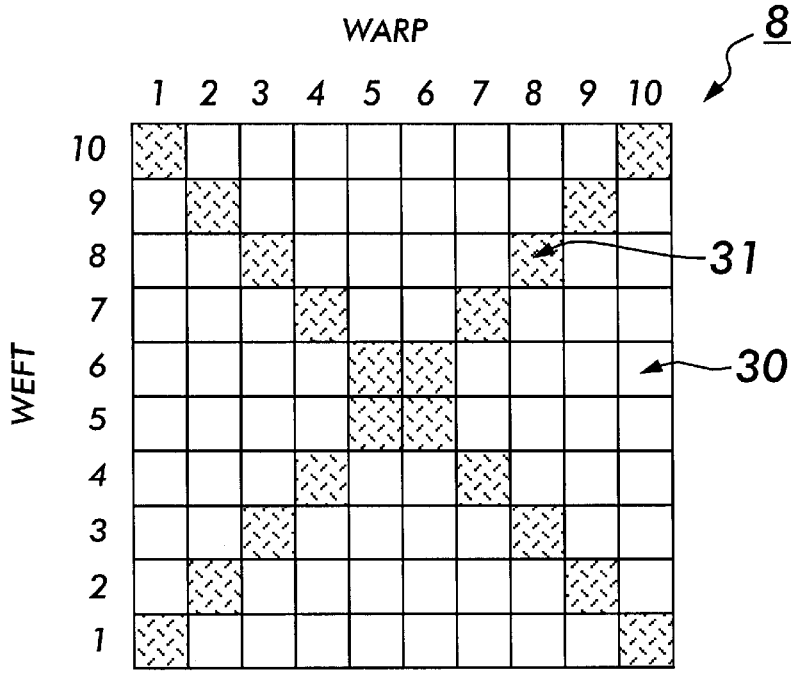
FIG.2A
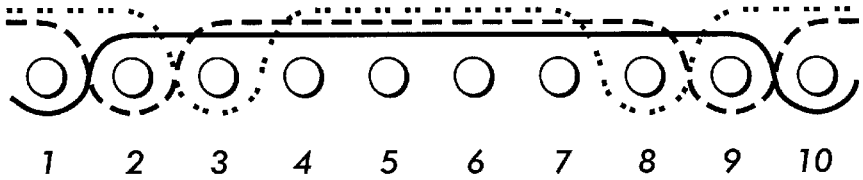
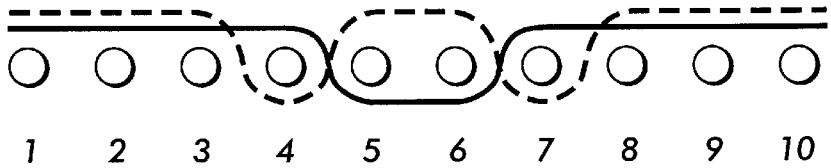
FIG.2B

FIG.8
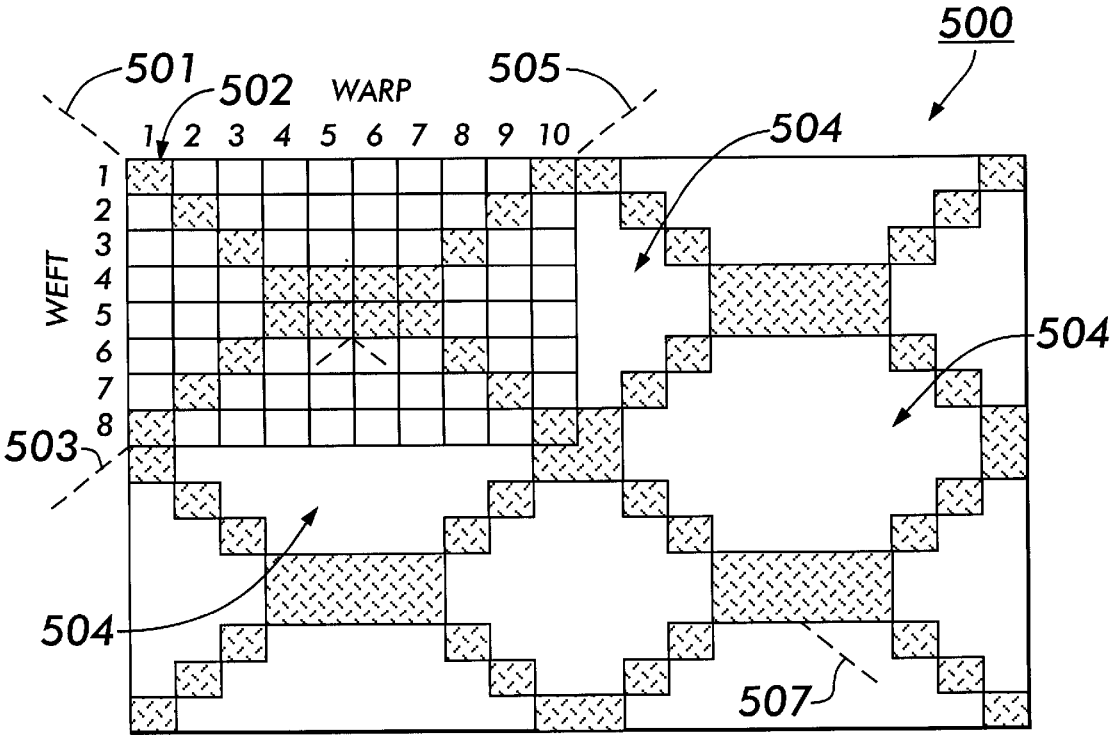
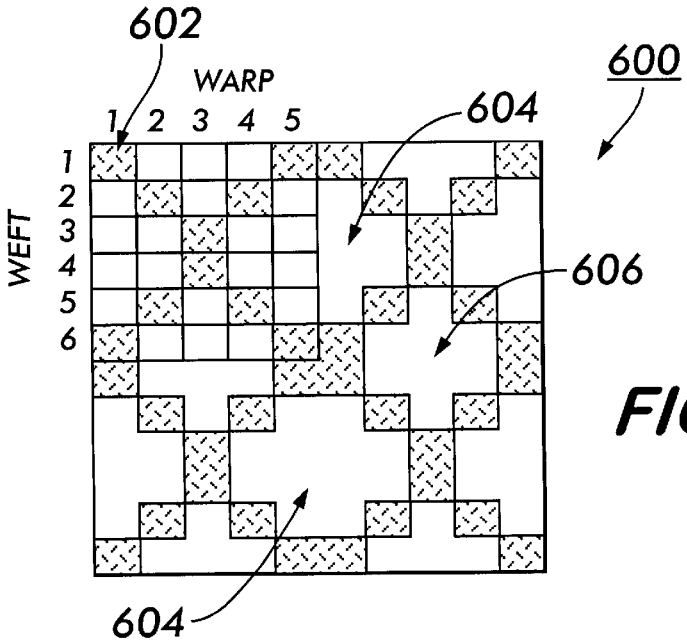
FIG.9

TISSUE FORMING FABRICS

RELATED APPLICATIONS

This application is based upon provisional application Ser. No. 60/098,913, entitled "Patterned Tissue Fabric" and filed on Sep. 1, 1998. Applicants claim the benefit of the filing date of that application.

FIELD OF THE INVENTION

This invention relates to fabrics for use in making patterned paper (e.g., tissue, towel stock and other wet formed cellulosic sheets) or nonwoven materials, and which are especially suitable for use as forming wires, transfer fabrics and dryer fabrics, particularly through-air-dryer (TAD) fabrics in tissue making machines.

The fabrics are intended primarily for use in wet forming processes, but may also be used for dry forming methods, e.g., wherein fibers are air-laid onto the fabric. Reference throughout this application to "wet forming processes" or "wet forming apparatus" refers to a complete web forming process or apparatus, respectively, which may include the patterning, transferring, drying and creping of an initially laid slurry of fibers from a head box or other delivery device or system onto a forming wire.

The structure of the fabric may be used to form patterns in the wet or dry formed sheet by shaping the sheet and/or by influencing the density or thickness of fiber deposits in a controlled manner.

BACKGROUND ART

Kimberly-Clark publication WO-96/35018 describes the formation of patterns in a paper or tissue sheet using additional structures on the surface of a woven fabric. The imprint in this case is caused by providing systematically distributed areas of restricted drainage in the fabric. As disclosed in the publication, the drainage may be impeded by incorporation of additional filaments or fibers on top of or within the forming fabric weave pattern, or by a film or coating which blocks or fills void space within the fabric through which water could otherwise drain. Over the areas of impeded drainage, a thinner layer of relatively long fibers tends to be deposited, whilst shorter fibers migrate and are concentrated in the areas of more rapid drainage producing a thicker, less translucent tissue over the faster drainage areas.

Gusums Bruk AB Swedish Patent 427,053 discloses a forming fabric structure wherein areas of different density are created by providing relatively dense areas wherein there is a high frequency of yarn interweavings, and relatively porous regions wherein there is a low frequency of yarn interweavings, which are dominated by weft floats. In certain disclosed embodiments the areas of low frequency interweavings provide physically raised areas that shape the tissue.

Chiu U.S. Pat. No. 5,429,686 discloses a TAD fabric with a distinct load-bearing woven fabric layer and an additional sculpture layer formed by additional long-floated machine direction yarns, with the floats standing proud of the main body of the load-bearing fabric layer to shape the formed sheet.

OBJECTS OF THE INVENTION

It is a general object of this invention to provide forming fabrics, transfer fabrics or dryer fabrics, particularly TAD fabrics, for use in forming paper (e.g., tissue, towel stock and other wet formed cellulosic sheets) or nonwoven sheet materials having an improved embossed or patterned structure.

It is another object of this invention to provide forming fabrics, transfer fabrics or dryer fabrics, particularly TAD fabrics, for use especially in a tissue making machine to form improved embossed or patterned tissue products.

It is another object of this invention to employ a forming, transfer or dryer fabric in a web forming apparatus to form a patterned fibrous web having a desired balance of properties and a cloth-like appearance and texture.

It is another object of this invention to provide a web shaping or embossing woven fabric without the incorporation of additional filaments or other structures therein.

It is yet another object of this invention to provide a web shaping or embossing woven fabric without the need to employ additional processing steps to introduce additional elements into the woven fabric structure.

SUMMARY OF THE INVENTION

The above and other objects of this invention are achieved by fabrics employed as forming, transfer or dryer fabrics in web forming apparatus, said fabrics being employed in making embossed or patterned fibrous web products, such as paper (e.g., tissue, towel stock and other wet formed cellulosic sheets) or non wovens. The fabrics of this invention comprise both single and multi-layer woven structures.

In accordance with preferred embodiments of this invention, the fabrics include at least one layer of yarns oriented in both first and second directions, said yarns being woven to provide a lattice, said lattice defining marginal edges of adjacent systematically distributed surface areas, with the distribution pattern, configuration and dimensions of said adjacent surface areas being dictated by the pattern of the lattice. The systematically distributed surface areas, which can, but are not required to be of the same configuration, weave pattern and/or dimensions, preferably include at least three yarns oriented in each of said first and second directions, and more preferably include at least four yarns oriented in each of said first and second directions.

In accordance with certain aspects of this invention, each yarn that is in both the lattice and in one or more systematically distributed surface areas defined by the lattice has an interlacing density in the lattice that is less than or equal to the interlacing density of that yarn in the systematically distributed surface areas. In connection with these aspects of the invention, the lattice most preferably is, but is not required to be within the definition of "lattice" set forth hereinafter. Throughout this application, applicants, when they do not intend to be limited to the definition of "lattice" set forth hereinafter, will refer to "lattice arrangement." However, the "lattice arrangement," like the "lattice," is required to define, or provide, marginal edges of adjacent systematically distributed surface areas.

In other aspects of this invention, wherein a yarn located in both the lattice and in one or more systematically distributed areas has an interlacing density in the lattice that is greater than the interlacing density in said one or more of the systematically distributed areas, the lattice must meet the definition of "lattice" set forth hereinafter.

The "lattice," which is of a chain link-like construction, in addition to defining marginal edges of adjacent systematically distributed surface areas, unless more specifically limited, means a weave pattern in which, in the fabric surface adjacent the formed sheet (hereinafter referred to as "the forming surface") more than 50% of the yarns defining the marginal edges of adjacent, systematically distributed areas have a zero interlacing density and wherein either all of the warp yarns or all of the weft yarns float over one, or continuously over more than one weft yarn or warp yarn, respectively, to form either a chain link-like array of warp floats or a chain link-like array of weft floats throughout the fabric on the forming surface; wherein when an array of warp floats is formed throughout the forming surface each warp float in the array either floats over the same weft yarn and/or over one or more adjacent weft yarns as adjacent warp floats in the array, and when an array of weft floats is formed throughout the forming surface each weft float in the array either floats over the same warp yarn and/or over one or more adjacent warp yarns as adjacent weft floats in the array.

More preferably, more than 75% of the yarns in the lattice that define the marginal edges of adjacent, systematically distributed areas have a zero interlacing density and most preferably 100% of such yarns have a zero interlacing density.

Reference to "zero interlacing density" in the lattice means that the warp or weft yarns that float over one or more weft yarns or warp yarns, respectively, remain on the forming surface and move out of the forming surface only at the perimeter of adjacent systematically distributed surface areas to define marginal edge segments of said areas.

Most preferably the lattice is "continuous" throughout the fabric, i.e., it defines the marginal edges of the systematically distributed areas about the entire perimeter of such areas.

To further explain, the lattice, which, as stated above, preferably is continuous, can be formed either by an array of warp floats of all of the warp yarns over one or more weft yarns, or alternatively by an array of weft floats of all of the weft yarns over one or more warp yarns. In the former case, each warp float in the array either floats over the same weft yarn and/or over one or more adjacent weft yarns as adjacent warp floats in the array. In the latter case, each weft float in the array either floats over the same warp yarn and/or over one or more adjacent warp yarns as adjacent weft floats in the array.

In certain preferred constructions, the lattice is continuous and is provided either by an array of warp floats in which each of the warp yarns floats over more than one weft yarn, or by an array of weft floats in which each of the weft yarns floats over more than one warp yarn, and wherein adjacent warp or weft floats provided by adjacent warp or weft yarns, respectively, at least partially overlap each other. That is, the adjacent warp or weft floats extend, or float over at least one weft or warp yarn, respectively, that is the same, and, if desired, over one or more adjacent weft or warp yarns.

Thus, in accordance with preferred embodiments of this invention, adjacent systematically distributed areas are separated by a continuous lattice wherein yarns oriented in one of the first or second directions of the woven pattern float under one or more successive yarns oriented in the other of said first or second directions.

The systematically distributed surface areas of predetermined configuration can have a variety of different weave patterns therein, as desired. In fact, different systematically distributed surface areas within a fabric can have different weave patterns to thereby provide areas that sit at different heights, or in different planes, within the fabric. Moreover, in the most preferred embodiments of the invention opposed edges of the yarns in the lattice define the perimeter, and therefore the configuration, of adjacent, spaced-apart, systematically distributed surface areas.

In certain embodiments the systematically distributed surface areas are of a low yarn interlacing density; being provided by successive yarns oriented in one of the first and second directions floating over two or more successive yarns oriented in the other of said first and second directions; these latter floats predominating the weave pattern in the systematically distributed surface areas. In fact, in accordance with certain embodiments of the invention the yarn interlacing density is zero, i.e., there are no interlacings within the body of the systematically distributed areas; the interlacings only occurring at margins of such areas.

In accordance with the broadest aspects of this invention, the systematically distributed areas do not need to be of a low yarn interlacing density, and can be of a high yarn interlacing density, such as a plain weave.

In accordance with certain preferred embodiments of this invention the systematically distributed surface areas that are predominately of a low yarn interlacing density provided by successive yarns oriented in one of the first and second directions of the weave pattern floating over two or more successive yarns oriented in the other of said first and second directions include an area therein wherein one or more of the successive yarns oriented in said one of the first and second directions interlaces with at least one yarn oriented in the other of said first and second directions to thereby interrupt the continuity of the yarn float over the yarns oriented in the other of said first and second directions. But for such interruption the yarn interlacing density would be zero.

In accordance with this invention the yarn types, cross-sectional areas, polymers, shapes, shrinkages, etc. employed in the fabrics, as well as their distribution throughout the fabrics, can be varied. For example, single multi filament or monofilament yarns in either the weft and or the warp systems may be replaced by paired yarns that follow identical weave paths. Conversely, where paired groupings occur naturally in the weave, these may be replaced with a thinner or thicker yarn to influence the yarn density.

Yarns of various diameters may be used selectively in weft and/or warp groups by grouping or alternations or otherwise to enhance the shaping effect on the formed sheets.

Equal diameter yarns may be paired, or yarns with different diameters can be paired together to reduce yarn crossover/twist during seaming of flat woven fabric; it being understood that seaming is not an issue in tubular woven fabrics in accordance with this invention. Pairs of profiled (i.e., non-circular cross-section) yarns preferably having engaging profiles, e.g., a round yarn paired with a profiled yarn having a profiled depression in the side adjacent the round yarn may be used. Such engaged profiled yarns hold together better to prevent twisting during seaming. These yarns lie roughly side-by-side rather than on top (i.e., over or under)of each other.

Shaping may alternatively be enhanced by using yarns having a significant difference in heat shrinkage values, for instance by alternating, grouping or otherwise distributing yarns in weft and/or warp groups to enhance the shaping effect.

For example one set of warp or weft yarns may have a shrinkage of 1–5%, and the other set of warp or weft yarns may have a shrinkage 10–20%. This difference of shrinkage distorts the fabric structure at an angle perpendicular to the plane of the fabric, leading to raised floats and/or knuckles that physically shape the sheet.

In other embodiments the yarns can be crimped at an angle perpendicular to the plane of the fabric to provide or enhance the height of the raised floats and/or knuckles that physically shape the sheet.

To alter drainage characteristics of the fabric some or all of the warp and/or weft yarns can be laterally crimped within the plane of the fabric.

Bicomponent yarns with differential shrinkage in the components, whether core and sheath, twisted or parallel bicomponent multi filaments may be used. The significant difference in shrinkage for monofilament yarns may be achieved using identical or different polymer family materials.

Shrinkage may be brought about by heat setting the fabric, and/or treating the fabric in a hot liquid, such as boiling water.

BRIEF DESCRIPTION OF THE DRAWINGS

Preferred embodiments of fabrics according to this invention will now be described by way of example, with reference to the accompanying drawings, wherein:

FIG. 1 is a weave pattern diagram of one repeat of a first embodiment of a forming fabric according to the invention;

FIGS. 2A and 2B are sectional views showing the paths of selected weft yarns in one pattern repeat of FIG. 1;

FIG. 8 is a weave pattern diagram of a sixth embodiment of a forming fabric according to the invention;

FIG. 9 is a weave pattern diagram of a seventh embodiment of a forming fabric according to the invention;

BEST MODES OF THE INVENTION

Figure 3:
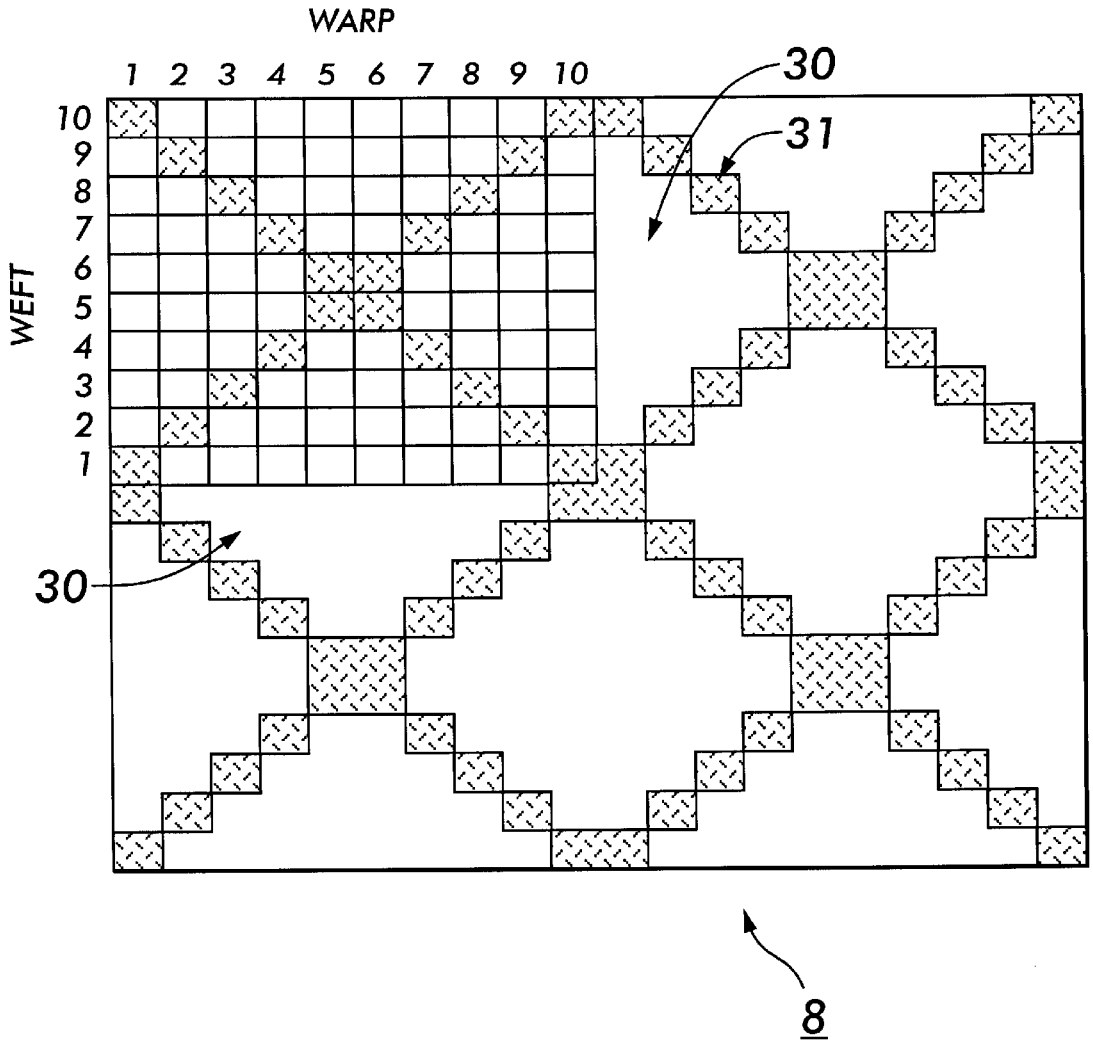
FIG. 3 is a weave pattern diagram of the first embodiment illustrated in FIG. 1, but showing more than a single repeat.

Referring to FIGS. 1 and 3, a fabric in accordance with a first embodiment of this invention is shown at 8, and includes a 10 warp by 10 weft yarn repeat pattern. Shaded squares each show where the respective weft thread, number 1 to 10 is woven below the respective warp thread number 1 to 10, and unshaded squares indicate that the weft thread is floated over the warp thread on the web contacting surface of the fabric.

It should be understood that for some forming, transferring and/or through drying applications the weave pattern can be reversed. In this latter case, the pattern of warp floats and weft floats will be the opposite of that depicted in FIGS. 1 and 3. FIG. 1 shows a single weave repeat of the embodiment. To understand how the embossing pattern develops it is preferable to refer to FIG. 3 wherein a multitude of weave repeats is represented.

As is illustrated best in FIG. 3, the warp floats formed by the interweaving define a continuous chain link-like lattice 31 surrounding systematically distributed diamond shaped surface areas 30. In the illustrated embodiment, each of the systematically distributed diamond-shaped areas 30 includes eight weft yarns floating continuously over eight warp yarns, i.e., the yarns in the systematically distributed areas have an interlacing density of zero. FIGS. 2A and 2B show sections of the fabric repeat, showing selected yarn paths of weft threads relative to warp threads. In FIG. 2A, weft yarn 1 (full line) is woven below warp yarns 1 and 10, whilst weft yarn 2 (dashed line) is woven below warp yarns 2 and 9, whilst weft yarn 3 (dotted line) is woven below warp yarns 3 and 8. In FIG. 2B the remaining weft yarns 4 (dashed line) and 5 (full line) are shown, woven under warp yarns 4 and 7; and 5 and 6 respectively. The remaining weft yarns 6–10 are disposed symmetrically in mirror image formation to the weft yarns 1–5. Thus 100% of the warp yarns defining the perimeter of adjacent systematically distributed areas have a zero interlacing density.

Figure 4:
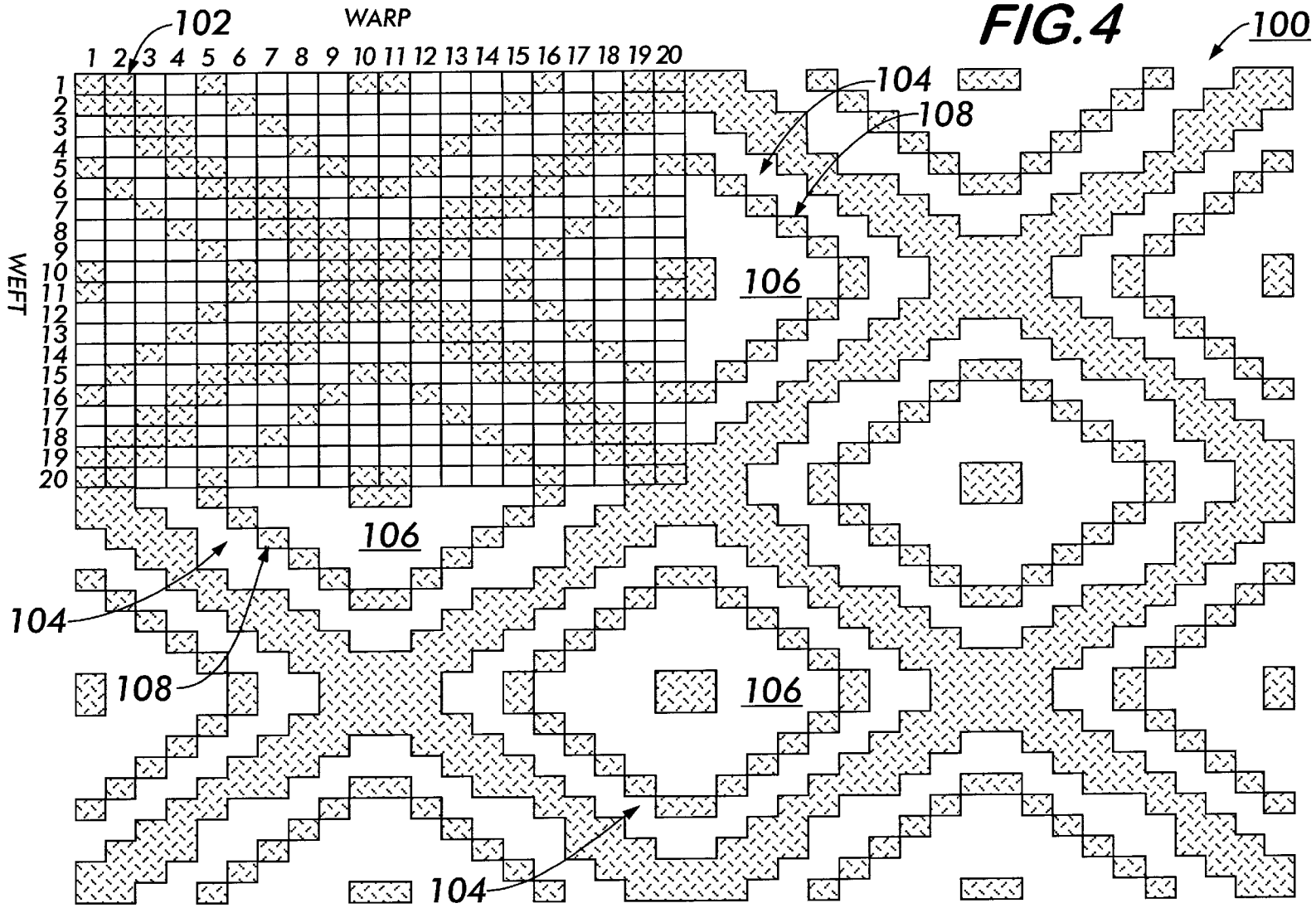
FIG. 4 is a weave pattern diagram of a second embodiment of a forming fabric according to the invention.

Referring to FIG. 4, another embodiment of a fabric in accordance with this invention is illustrated at 100. This fabric, as is the case with all of the fabrics of this invention, can be employed in machines for manufacturing non woven webs, as well as a forming wire, a transfer wire and/or a TAD fabric in a papermaking, or other wet forming machine or process. Referring to FIG. 4, the dark areas are areas in which warp yarns float over weft yarns, and the light areas are areas in which weft yarns float over warp yarns. This fabric 100 is a 20 shaft, 20 pick weave. That is, the weave pattern of the warp yarns repeats every twenty yarns, and the weave pattern of the weft yarns repeats every twenty yarns.

Still referring to FIG. 4, the fabric 100 has a continuous chain link-like lattice 102 on the depicted surface, which is provided by warp floats of each of the warp yarns over more than one weft yarn, and wherein the warp floats provided by each of the warp yarns at least partially overlaps a warp float provided by an adjacent warp yarn. In fact, the portion of the continuous lattice provided by warp yarns 1 through 9 floating over weft yarns 1 through 20 is provided by adjacent, partially overlapping warp floats of the adjacent warp yarns. Likewise, the portion of the continuous lattice provided by warp yarns 12 through 20 floating over weft yarns 1 through 20 is provided by adjacent, partially overlapping warp floats of the adjacent warp yarns. In this embodiment of the invention, like the embodiment 8, 100% of the yarns in the continuous lattice that define the marginal edges of adjacent systematically distributed surface areas 104 have a zero interlacing density.

To further explain, within a single weave repeat, the continuous lattice 102 is provided by warp floats of varying length. Each warp yarn 1 and 20 floats over weft yarns 1 and 2, and also over weft yarns 19 and 20. Adjacent portions of the continuous lattice are provided by warp floats of warp yarns 2 and 19 over weft yarns 1 through 3 and also over weft yarns 18 through 20. Thus, the warp floats of warp yarns 2 and 19 over weft yarns 1 through 3 partially overlap the warp floats of warp yarns 1 and 20 over weft yarns 1 and 2, respectively. Likewise, the warp floats of warp yarns 2 and 19 over weft yarns 18 through 20 partially overlap the warp floats of warp yarns 1 and 20 over weft yarns 19 and 20, respectively.

Still referring to FIG. 4, the continuous lattice 102 defines, or separates, a plurality of systematically distributed surface areas 104 of a configuration determined by the configuration of the continuous lattice. As illustrated, each systematically distributed area 104 bound by the continuous lattice 102 is essentially diamond-shaped and includes sixteen successive yarns in each of the warp and weft directions.

Within each systematically distributed area 104 is a smaller diamond-shaped area 106 bound by a diamond-shaped pattern of warp floats 108 provided by a group of adjacent warp yarns interrupting weft floats that are provided by a group of adjacent weft yarns. In the center of each of the smaller diamond-shaped areas 106 is an area provided by adjacent warp yarns (e.g., 10, 11) floating over a pair of adjacent weft yarns (e.g., 1, 20).

Figure 5:
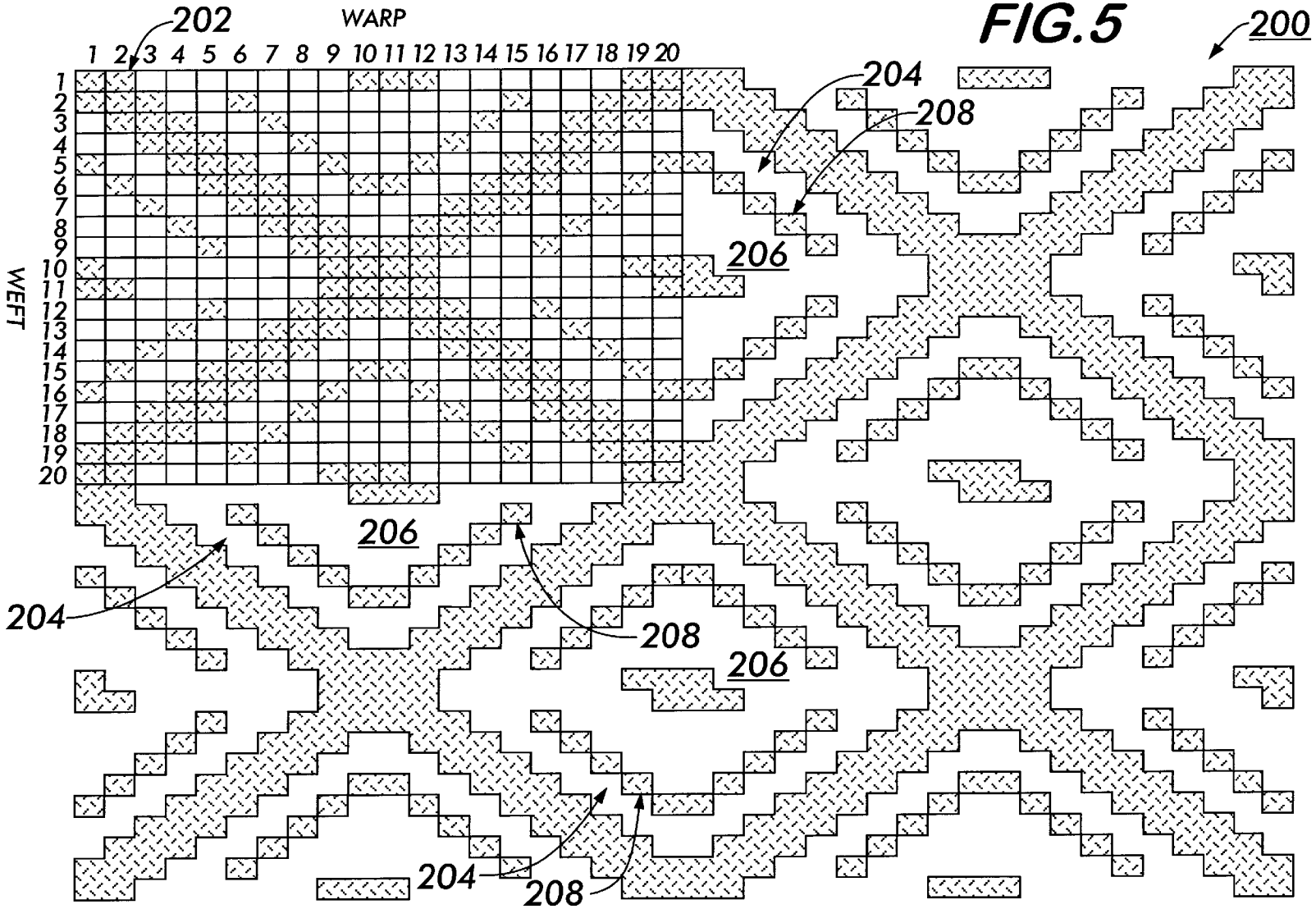
FIG. 5 is a weave pattern diagram of a third embodiment of a forming fabric according to the invention.

Referring to FIG. 5, an additional embodiment of a fabric in accordance with this invention is illustrated at 200. In particular, the dark areas are areas in which warp yarns float over weft yarns, and the light areas are areas in which weft yarns float over warp yarns. This fabric 200, like the fabric 100, is a 20 shaft, 20 pick weave. That is, the weave pattern of the warp yarns repeats every twenty yarns, and the weave pattern of the weft yarns repeats every twenty yarns.

Still referring to FIG. 5, the chain link 4 like lattice 202 on the depicted surface is continuous. In particular, the continuous lattice 202, like the continuous lattice 102 (FIG. 4), has an interlacing density of zero and is provided by warp floats of each of the warp yarns over more than one weft yarn; wherein the warp floats provided by each of the warp yarns at least partially overlaps a warp float provided by an adjacent warp yarn. In fact, the portion of the continuous lattice provided by warp yarns 1 through 9 floating over weft yarns 1 through 20 is provided by adjacent, partially overlapping warp floats of the adjacent warp yarns. Likewise, the portion of the continuous lattice provided by warp yarns 12 through 20 floating over weft yarns 1 through 20 is provided by adjacent, partially overlapping warp floats of the adjacent warp yarns.

To further explain, within a single repeat, a portion of the continuous lattice 202 is provided by warp floats of each of warp yarns 1 and 20 over weft yarns 1 and 2, and also over weft yarns 19 and 20. Adjacent portions of the continuous lattice are provided by warp floats of warp yarns 2 and 19 over weft yarns 1 through 3 and also over weft yarns 18 through 20. Thus, the warp floats of warp yarns 2 and 19 over weft yarns 1 through 3 partially overlap the warp floats of warp yarns 1 and 20 over weft yarns 1 and 2, respectively. Likewise, the warp floats of warp yarns 2 and 19 over weft yarns 18 through 20 partially overlap the warp floats of warp yarns 1 and 20 over weft yarns 19 and 20, respectively.

Still referring to FIG. 5, the continuous lattice defines, or separates, a plurality of systematically distributed surface areas 204 of a predetermined configuration. As illustrated, each systematically distributed area 204 bound by the lattice is essentially diamond-shaped and includes sixteen successive yarns in both the warp and weft directions.

Within each systematically distributed area 204 is a smaller, essentially diamond-shaped area 206 bound by an essentially diamond-shaped pattern of warp floats 208 provided by a group of adjacent warp yarns interrupting weft floats that are provided by a group of adjacent weft yarns. The continuity of the essentially diamond-shaped pattern of warp floats 208 is interrupted by the omission of warp floats at the opposed transverse ends of the pattern. For example, warp yarns 6 and 15 do not provide any warp floats within the systematically distributed areas 204 to close the diamond configuration of the warp floats 208.

In the center of each of the smaller, essentially diamond-shaped areas 206 is an area provided by overlapping warp floats. Specifically, warp yarns 19, 20 and 1 float over weft yarn 10 and warp yarns 20, 1 and 2 float over weft yarn 11. Thus, adjacent warp yarns 20 and 1 float over adjacent weft yarns 10 and 11.

Figure 6:
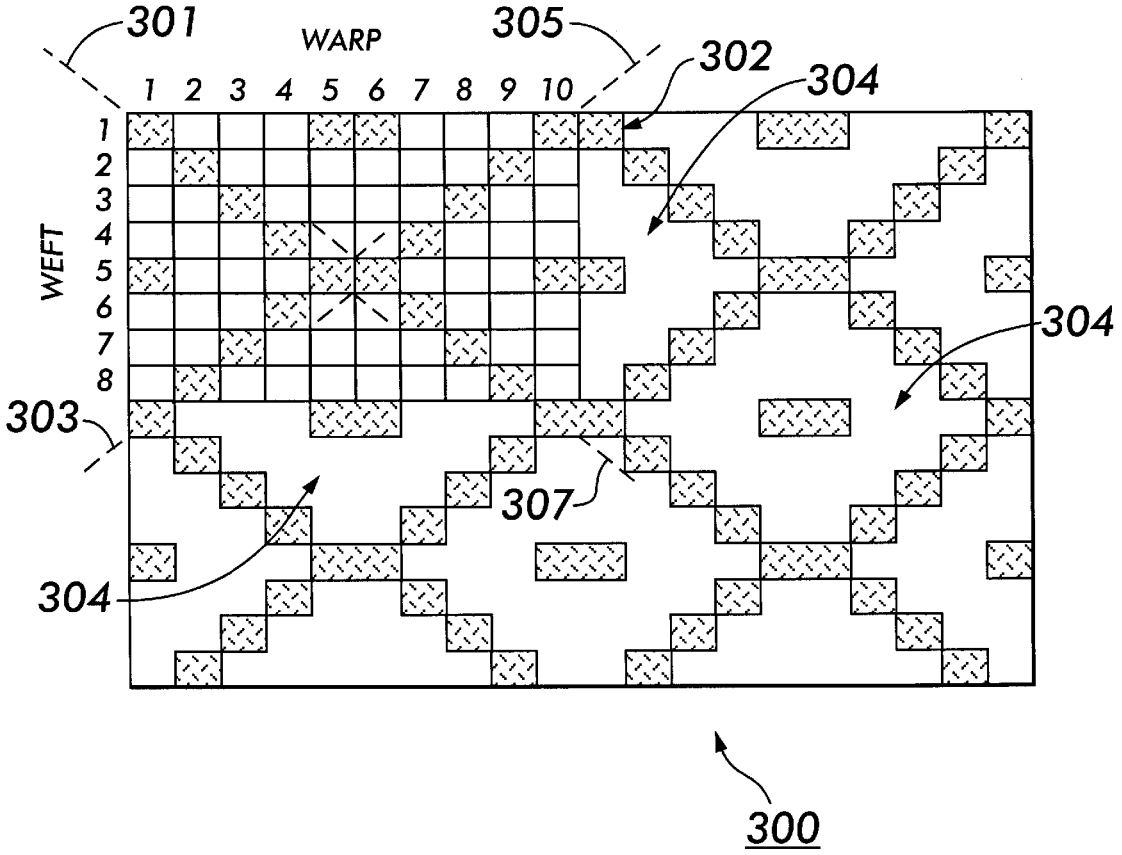
FIG. 6 is a weave pattern diagram of a fourth embodiment of a forming fabric according to the invention.

Referring to FIG. 6, an additional embodiment of a fabric in accordance with this invention is illustrated at 300. In particular, the dark areas are areas in which warp yarns float over weft yarns, and the light areas are areas in which weft yarns float over warp yarns. This fabric is a 10 shaft, 8 pick weave. That is, the weave pattern of the warp yarns repeats every 10 yarns, and the weave pattern of the weft yarns repeats every 8 yarns.

Still referring to FIG. 6, the chain link-like lattice 302 on the depicted surface is continuous and has an interlacing density of zero. This continuous lattice 302, within each repeat, is provided by warp floats of each of the warp yarns over a single weft yarn, and wherein the warp floats provided by each of the warp yarns are immediately adjacent a warp float provided by an adjacent warp yarn. Specifically, the portion of the continuous lattice provided by warp yarns 1 through 5 floating over weft yarns 1 through 8 is in the form of diagonally converging lines 301, 303 of adjacent and warp floats, with the warp float provided by warp yarn 5 passing over weft yarn 5 being common to both lines. Likewise, the portion of the continuous lattice provided by warp yarns 6 through 10 floating over weft yarns 1 through 8 is in the form of diagonally diverging lines 305, 307 of adjacent and warp floats, with the warp float provided by the warp yarn 6 passing over the weft yarn 5 being common to both lines.

Still referring to FIG. 6, the continuous lattice 302 defines, or separates, a plurality of systematically distributed surface areas 304 of a predetermined configuration. As illustrated, each systematically distributed area 304 bound by the lattice is essentially diamond-shaped, and is defined predominately by weft yarns floating over warp yarns. In fact, except for the weft floats being interrupted by two adjacent warp yarns (e.g., 1 and 10) floating over the same single weft yarn (e.g., 5), each of the systematically distributed surface areas 304 is provided entirely by weft yarns floating over warp yarns. In this embodiment each area 304 includes eight successive warp yarns and seven successive weft yarns.

Figure 7:
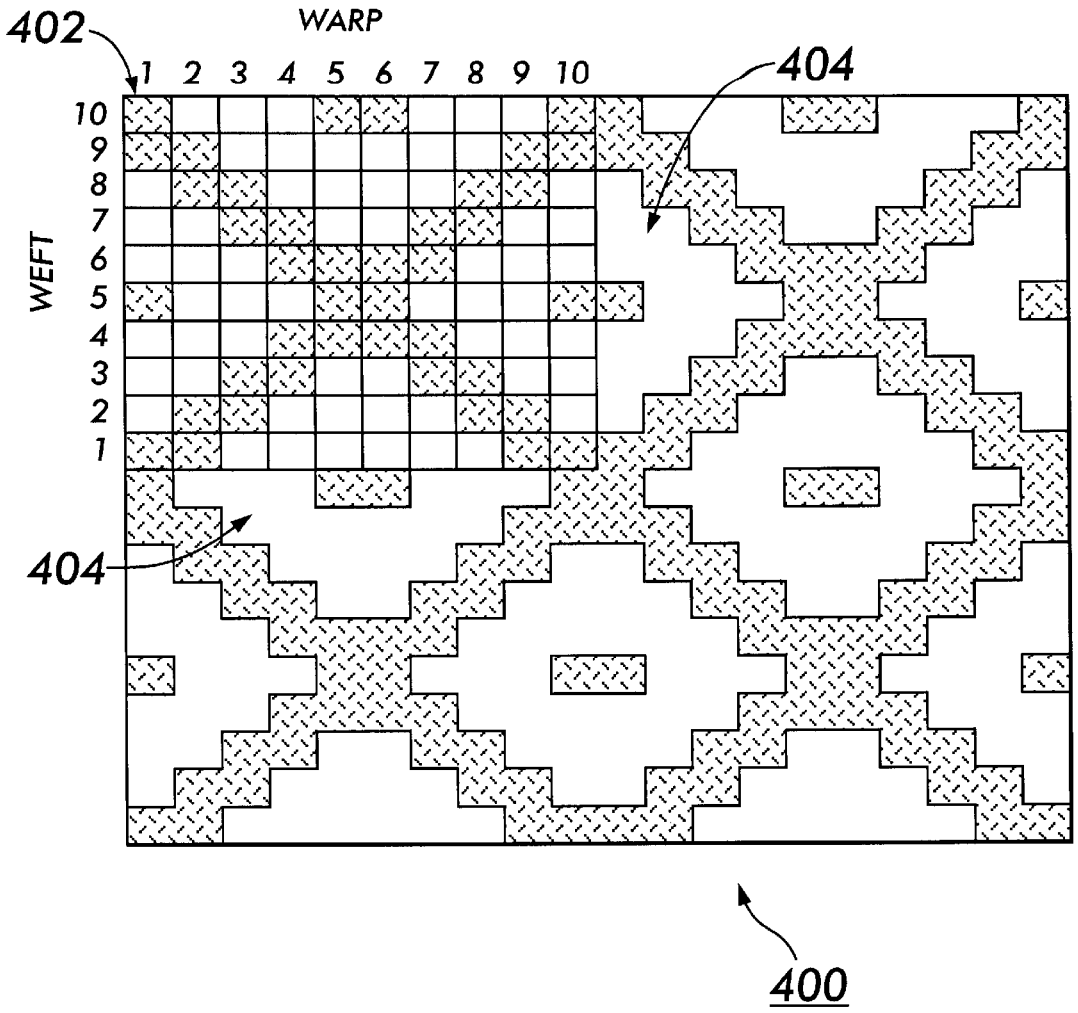
FIG. 7 is a weave pattern diagram of a fifth embodiment of a forming fabric according to the invention.

Referring to FIG. 7, another embodiment of a fabric in accordance with this invention is illustrated at 400. In particular, the dark areas are areas in which warp yarns float over weft yarns, and the light areas are areas in which weft yarns float over warp yarns. This fabric is a 10 shaft, 10 pick weave. That is, the weave pattern of the warp yarns repeats every 10 yarns, and the weave pattern of the weft yarns repeats every 10 yarns.

Still referring to FIG. 7, chain link-like lattice 402 on the depicted surface is continuous with an interlacing density of zero. This continuous lattice 402 is provided by warp floats of each of the warp yarns over more than one weft yarn, and wherein the warp floats provided by each of the warp yarns at least partially overlaps a warp float provided by an adjacent warp yarn. In fact, the portion of the continuous lattice provided by warp yarns 1 through 5 floating over weft yarns 1 through 10 is provided by adjacent, overlapping warp floats of the adjacent warp yarns. Likewise, the portion of the continuous lattice provided by warp yarns 6 through 10 floating over weft yarns 1 through 10 is provided by adjacent, overlapping warp floats of the adjacent warp yarns.

To further explain, within a single weave repeat, a portion of the continuous lattice 402 is provided by warp floats of each of warp yarns 1 and 10 over weft yarn 1, and also over weft yarns 9 and 10. Adjacent portions of the continuous lattice are provided by warp floats of warp yarns 2 and 9 over weft yarns 1 and 2, and also over weft yarns 8 and 9. Thus, the warp floats of warp yarns 2 and 9 over weft yarns land 2 partially overlap the warp floats of warp yarns 1 and 10 over weft yarn 1, respectively. Likewise, the warp floats of warp yarns 2 and 9 over weft yarns 8 and 9 partially overlap the warp floats of warp yarns 1 and 10 over weft yarns 9 and 10, respectively.

Still referring to FIG. 7, the continuous lattice 402 defines, or separates, a plurality of systematically distributed surface areas 404 of a predetermined configuration. As illustrated, each systematically distributed area 404 bound by the lattice 402 is essentially diamond-shaped and includes eight warp yarns and seven weft yarns.

Each of the systematically distributed areas 404 is dominated by weft floats. In fact; except for warp floats provided by two adjacent warp yarns (e.g., 5, 6) floating over a single weft yarn (e.g., 10) each of the systematically distributed areas 404 is provided by weft floats. This results in the systematically distributed areas 404 being of a low yarn interlacing density.

Referring to FIG. 8, another embodiment of a fabric in accordance with this invention is illustrated at 500. In particular, the dark areas are areas in which warp yarns float over weft yarns, and the light areas are areas in which weft yarns float over warp yarns. This fabric is a 10 shaft, 8 pick weave. That is, the weave pattern of the warp yarns repeats every 10 yarns, and the weave pattern of the weft yarns repeats every 8 yarns.

Still referring to FIG. 8, chain link-like lattice 502 is continues and has an interlacing density of zero. This continuous lattice 502 on the depicted surface is provided by warp floats of each of warp yarns 2, 3, 8 and 9 over single, spaced apart weft yarns, and by warp floats of each of warp yarns 1, 4 through 7 and 10 over a pair of adjacent weft yarns. Specifically, the portions of the continuous lattice provided by warp yarns 1 through 4 floating over weft yarns 1 through 8 are aligned in diagonally converging lines 501, 503. Likewise, the portions of the continuous lattice provided by warp yarns 7 through 10 floating over weft yarns through 8 are aligned in diagonally diverging lines 505, 507. In addition, warp yarns 4 through 7 each float over weft warns 4 and 5 to form a rectangular array of warp floats.

Referring to FIG. 9, yet another embodiment of a fabric in accordance with this invention is illustrated at 600. In particular, the dark areas are areas in which warp yarns float over weft yarns, and the light areas are areas in which weft yarns float over warp yarns. This fabric is a 5 shaft, 6 pick weave. That is, the weave pattern of the warp yarns repeats every 5 yarns, and the weave pattern of the weft yarns repeats every 6 yarns.

Still referring to FIG. 9, a chain link-like lattice 602 is continuous and has in interlacing density of zero. This continuous lattice 602 on the depicted surface is provided by warp floats of each of warp yarns 2 and 4 over single, spaced apart weft yarns, and by a warp float of warp yarns 1, 3 and 5 over a pair of adjacent weft yarns. Specifically, warp yarns 1 and 5 float over weft yarns 1 and 6; warp yarns 2 and 4 float over weft yarns 2 and 5 and warp yarn 3 floats over weft yarns 3 and 4.

Still referring to FIG. 9, the continuous lattice 602 defines, or separates, a plurality of systematically distributed surface areas 604 and 606, which are of a configuration determined by the lattice arrangement. As illustrated, it should be apparent that the systematically distributed surface areas 604 bound by the lattice are defined by four weft yarns floating over four warp yarns, whereas the systematically distributed surface areas 606 are of a different size, being defined by four waft yarns floating over three warp yarns.

Figure 10:
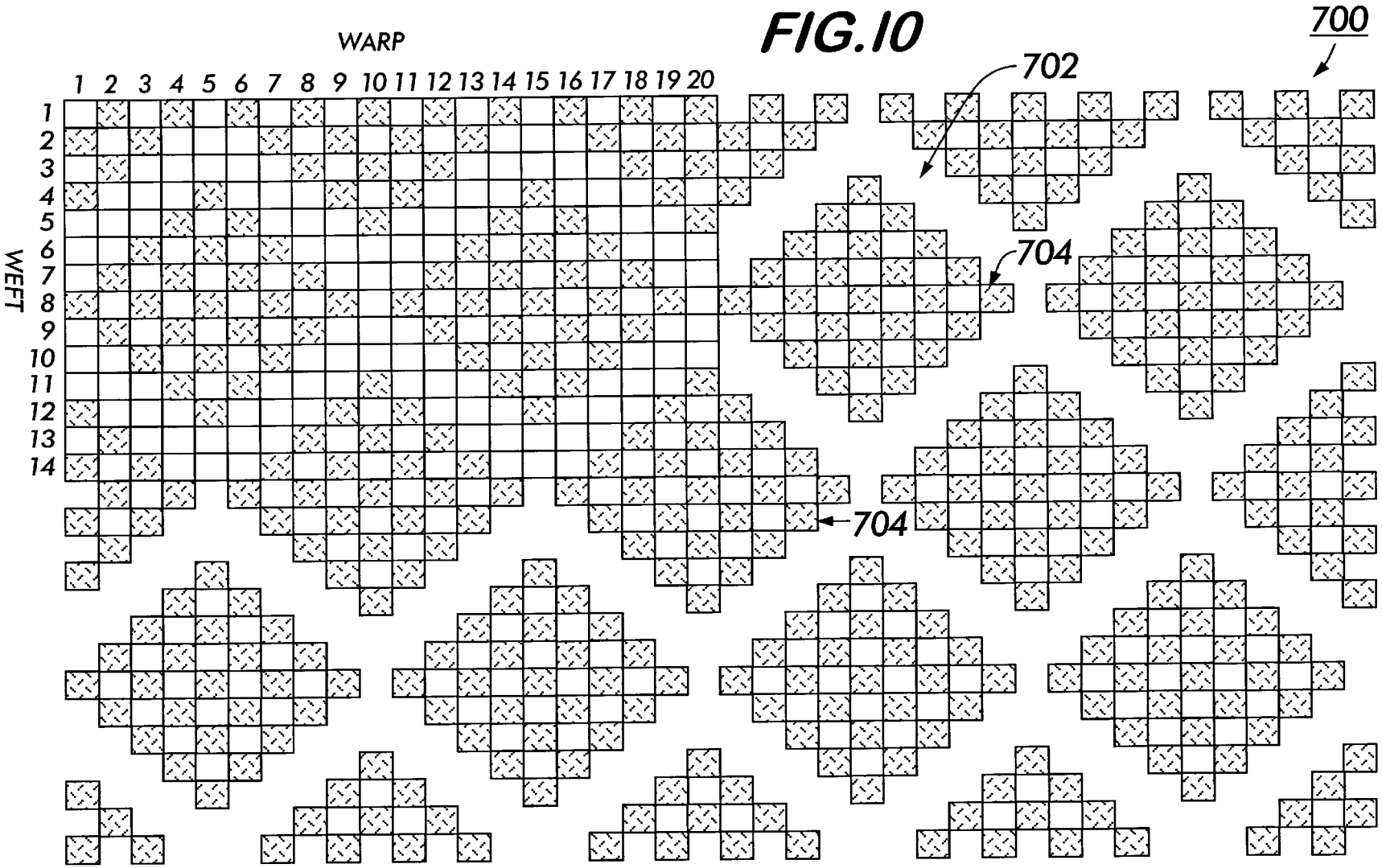
FIG. 10 is a weave pattern diagram of an eighth embodiment of a forming fabric according to the invention.

Referring to FIG. 10, yet another embodiment of a fabric in accordance with this invention is illustrated at 700. In particular, the dark areas are areas in which warp yarns float over weft yarns, and the light areas are areas in which weft yarns float over warp yarns. This fabric is a 20 shaft, 14 pick weave. That is, the weave pattern of the warp yarns repeats every 20 yarns, and the weave pattern of the weft yarns repeats every 14 yarns.

Still referring to FIG. 10, a chain link-like lattice 702 is continuous and has an interlacing density of zero. This continuous lattice 702 defines, or separates, a plurality of systematically distributed surface areas 704 which are of a an essentially diamond-shaped configuration determined by the arrangement of the continuous lattice. As illustrated, it should be apparent that the systematically distributed surface areas 704 bound by the lattice are defined by a high interlacing density, plain weave pattern including nine weft yarns interlacing with nine warp yarns.

Figure 11:
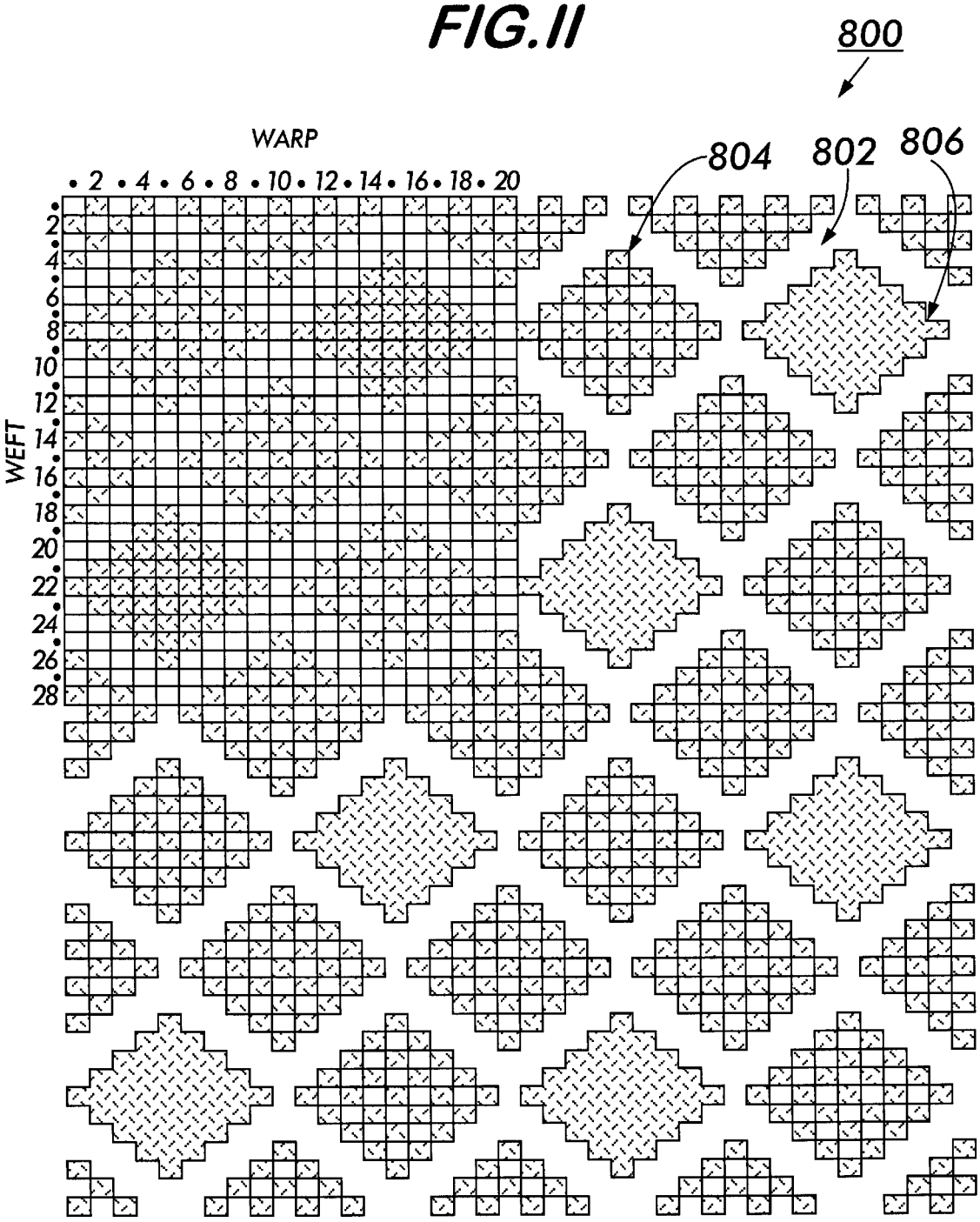
FIG. 11 is a weave pattern diagram of an ninth embodiment of a forming fabric according to the invention.

Referring to FIG. 11, yet another embodiment of a fabric in accordance with this invention is illustrated at 800. In particular, the dark areas are areas in which warp yarns float over weft yarns, and the light areas are areas in which weft yarns float over warp yarns. This fabric is a 20 shaft, 28 pick weave. That is, the weave pattern of the warp yarns repeats every 20 yarns, and the weave pattern of the weft yarns repeats every 28 yarns.

Still referring to FIG. 11, a chain link-like lattice 802 is continuous and has an interlacing density of zero. This continuous lattice 802 defines, or separates, a plurality of systematically distributed surface areas 804 and 806, which are of an essentially diamond-shaped configuration determined by the arrangement of the continuous lattice, but differing in interlacing density. As illustrated, it should be apparent that the systematically distributed surface areas 804 defined by the lattice are areas of a high interlacing density, plain weave pattern including nine weft yarns interlacing with nine warp yarns, and the systematically distributed surface areas 806 are defined by a zero interlacing density pattern including nine warp yarns floating over nine weft yarns. The yarns in the systematically distributed surface areas having different interlacing densities will sit at different levels, thereby imparting, or creating a multilevel shape or pattern in the formed web.

Figure 12:
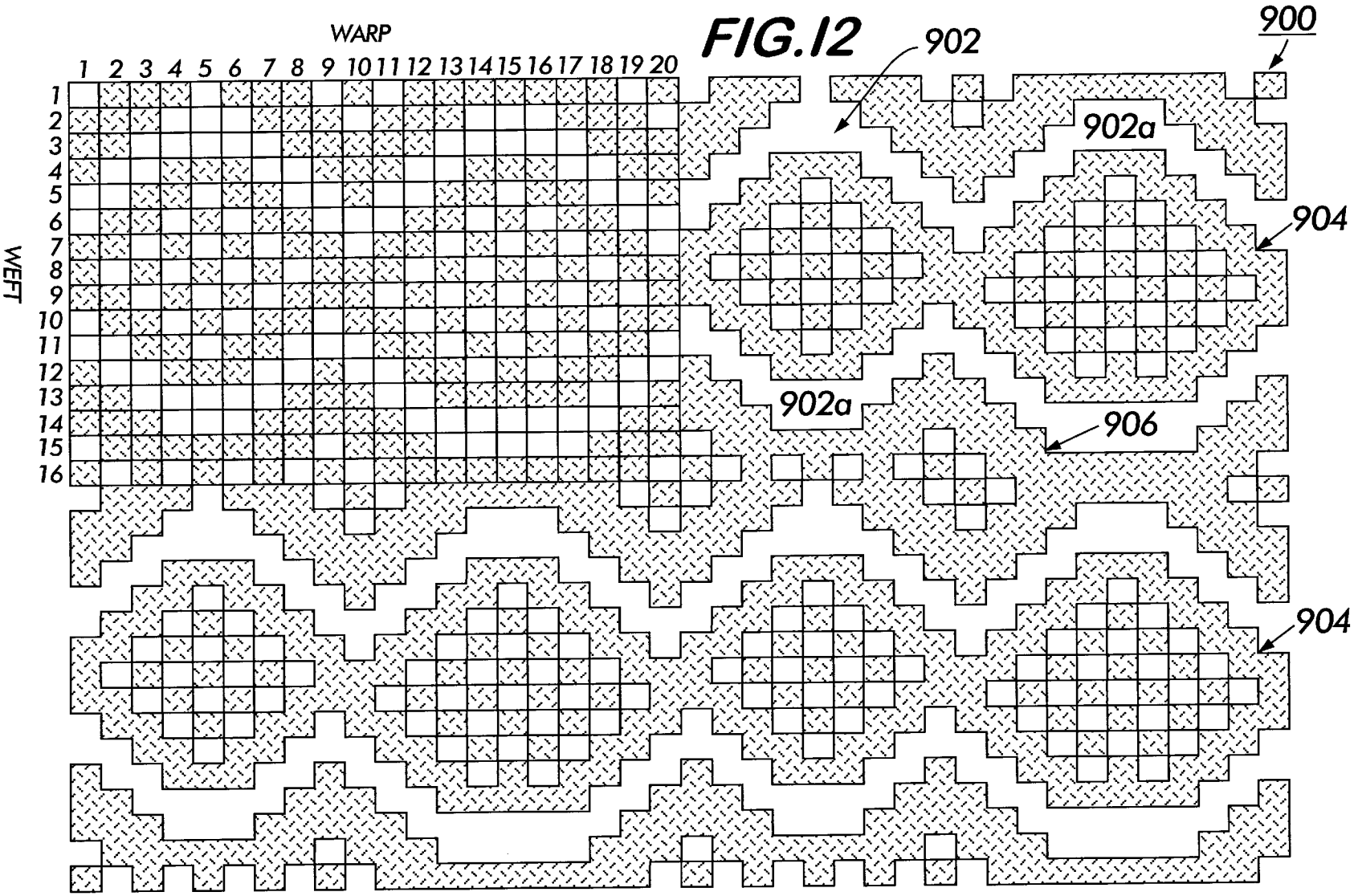
FIG. 12 is a weave pattern diagram of an tenth embodiment of a forming fabric according to the invention.

Referring to FIG. 12, yet another embodiment of a fabric in accordance with this invention is illustrated at 900. In particular, the dark areas are areas in which warp yarns float over weft yarns, and the light areas are areas in which weft yarns float over warp yarns. This fabric is a 20 shaft, 16 pick weave. That is, the weave pattern of the warp yarns repeats every 20 yarns, and the weave pattern of the weft yarns repeats every 16 yarns.

Still referring to FIG. 12, a lattice 902 is interrupted to provide a plurality of discrete segments in the form of discontinuous lattice areas 902*a*, each having an interlacing density of zero. Each of the discontinuous lattice areas 902*a* has a zig-zag, or herringbone-configured area that extends in the weft direction and is spaced apart from adjacent lattice areas 902*a* in the warp direction. Pairs of adjacent, spaced-apart lattice areas 902*a* define, or separate, a plurality of systematically distributed surface areas, e.g., 904 and 906. In other words, a pair of adjacent, spaced-apart lattice areas 902*a* is required to define the entire outer margin or perimeter of each systematically distributed surface area 904 and 906. As illustrated, it should be noted that the systematically distributed surface areas 904 and 906 have weave patterns that differ from each other, and also from the zero interlacing pattern of the adjacent lattice areas 902. This creates, or provides, areas of different heights, or levels in the fabric, that, likewise, create a multilevel pattern in the webs formed with the use of the fabric 900.

Figure 13:
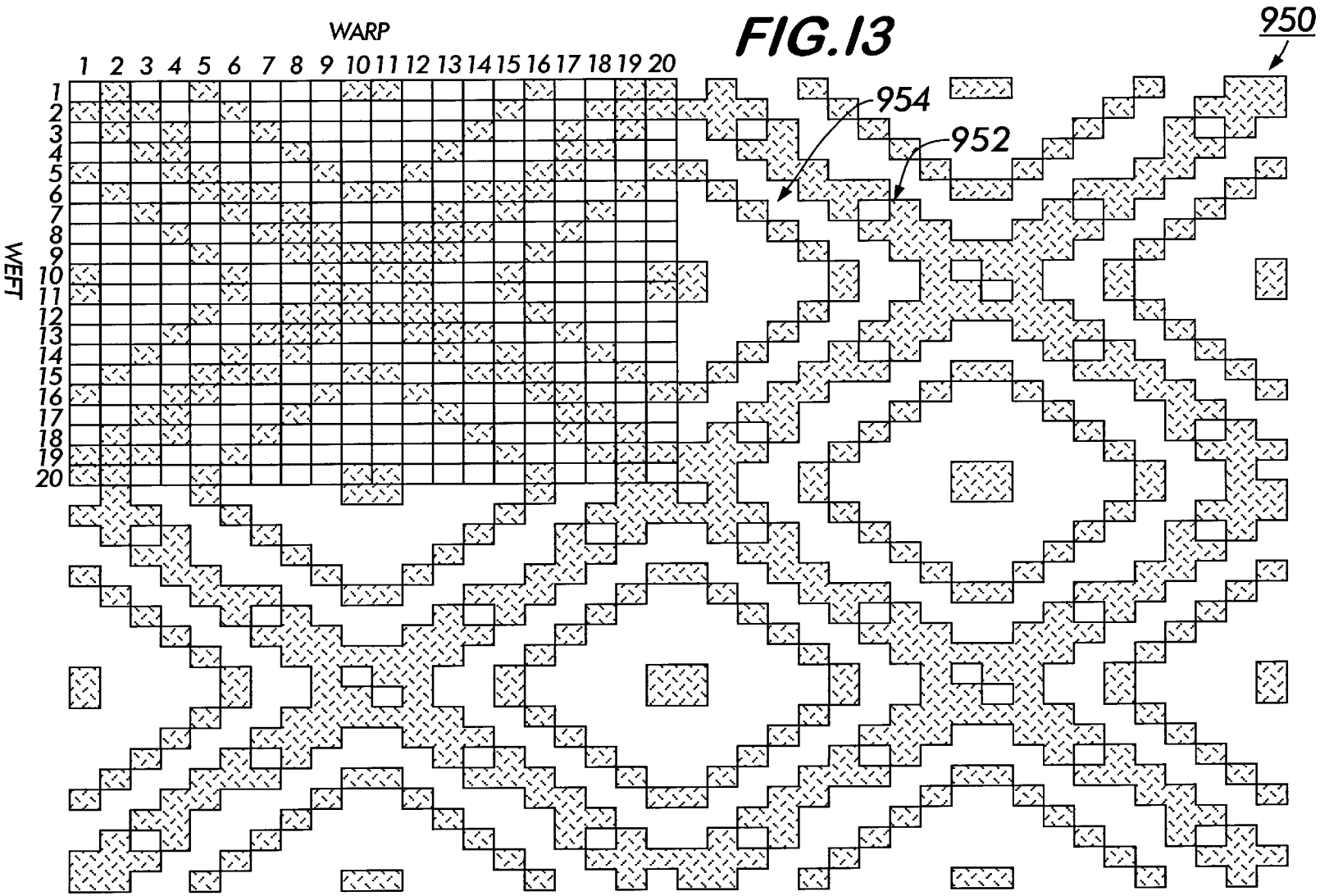
FIG. 13 is a weave pattern diagram of a eleventh embodiment of a forming fabric according to the invention.

Referring to FIG. 13, yet another embodiment of a fabric in accordance with this invention is illustrated at 950. In particular, the dark areas are areas in which warp yarns float over weft yarns, and the light areas are areas in which weft yarns float over warp yarns. This fabric is a 20 shaft, 20 pick weave and is very similar to the fabric 100 illustrated in FIG. 4. In fact, the fabric 950 has a chain link-like lattice 952 defining systematically distributed surface areas 954 that are identical to the surface areas 104 of the fabric 100.

The fabric 950 differs from the fabric 100 solely in the arrangement of the lattice 952. Specifically, the lattice 952 differs from the lattice 102 of fabric 100 in that the continuous float of the weave pattern in 40% of the yarns (i.e., 8 of the 20 warp yarns in each repeat of the weave pattern) of the lattice 952 is interrupted so that 40% of the yarns have an interlacing density greater than zero. As illustrated, within each weave repeat weft yarn 1 passes over warp yarn 1, weft yarn 3 passes over warp yarns 3 and 18, weft yarn 7 passes over warp yarns 7 and 14, weft yarn 10 passes over warp yarn 10, weft yarn 11 passes over warp yarn 11, weft yarn 14 passes over warp yarns 7 and 14, weft yarn 18 passes over warp yarns 3 and 18 and weft yarn 20 passes over warp yarn 20 to thereby interrupt the continuity of the float of 40% of the yarns in the lattice 952.

As noted earlier in this application, the fabrics of this invention can be used in a variety of web forming operations; both wet and dry. Moreover, the fabrics of this invention may be used to provided different functions within the web forming process. For example, the fabric may be employed as a forming wire in a wet sheet forming process; as a transfer fabric in such a process and/or as a dryer fabric in such a process.

It also should be noted that in all of the illustrated embodiments the shaded areas represent warp yarns floating over weft yarns. It should be understood that this arrangement can be reversed, with the shaded areas depicting weft yarns passing over warp yarns.

It also should be noted that the weave pattern within each systematically distributed area can be varied within the broadest aspects of this invention. Thus, although the embodiments illustrated herein include systematically distributed areas of low yarn interlacing density, it is within the scope of this invention to vary the weave pattern with the systematically distributed areas to provide high yarn interlacing density regions therein.

Also, the pattern, or configuration, of the continuous lattice and of the systematically distributed areas can be varied; the specific pattern not constituting a limitation on the broadest aspects of this invention.

In certain applications, the continuous lattice is provided by high knuckles and the fabric is employed to emboss, or compress the formed sheet to enhance the strength of the formed sheet in all directions.

In accordance with this invention the spacing of the weft yarns may be varied by intermittent activation of devices such as direct DC loom drive, and AC servo drives for warp yarn let off and fabric take up. In addition the order of reed denting may be varied to enhance warp yarn groupings.

Without further elaboration, the foregoing will so fully illustrate my invention that others may, by applying current or future knowledge, adapt the same for use under various conditions of service.

What we claim as the invention is:

1. A fabric employed in a web-forming apparatus to form a patterned fibrous web, said fabric including a web-contacting surface for engaging a fibrous web and assisting in imparting a pattern in said web, said fabric including only a single layer of yarns oriented in first and second directions and being woven to provide a lattice, said lattice separating a plurality of systematically distributed surface areas of a predetermined configuration that are defined by the lattice; said systematically distributed surface areas including at least three yarns oriented in each if said first and second directions.

2. The fabric of claim 1, wherein the lattice is continuous.

3. The fabric of claim 1, wherein at least 75% of the yarns in the lattice have a zero interlacing density.

4. The fabric of claim 1, wherein 100% of the yarns in the lattice have a zero interlacing density.

5. The fabric of claim 1, wherein the lattice is discontinuous and includes discrete segments separated from each other by systematically distributed surface areas.

6. The fabric of claim 1, wherein the size of at least one of the systematically distributed surface areas differs from the size of at least another of said systematically distributed surface areas.

7. The fabric of claim 1, wherein the yarn interlacing density of at least one of the systematically distributed surface areas differs from the yarn interlacing density of at least another of said systematically distributed surface areas.

8. The fabric of claim 1, wherein the configuration of at least one of the systematically distributed surface areas differs from, the configuration of at least another of said systematically distributed surface areas.

9. The fabric of claim 7, wherein at least one of said systematically distributed surface areas utilizes a plain weave.

10. The fabric of claim 1, wherein the weave pattern in the systematically distributed surface areas is the same.

11. The fabric of claim 1, wherein the weave pattern in at least one of the systematically distributed surface areas differs from the weave pattern in at least another of said systematically distributed surface areas.

12. The fabric of claim 1, wherein the interlacing density is zero in each systematically distributed surface area.

13. The fabric of claim 1, wherein the interlacing density in each systematically distributed surface area is greater than the interlacing density in the lattice.

14. The fabric of claim 1, wherein the interlacing density in each systematically distributed surface area is equal to the interlacing density in the lattice.

15. The fabric of claim 1 being a forming wire in a wet forming apparatus.

16. The fabric of claim 1 being a through-air drying fabric in a wet forming apparatus.

17. The fabric of claim 1 being a transfer fabric in a wet forming apparatus.

18. The fabric of claim 1 being a forming wire in a dry forming apparatus.

19. The fabric of claim 1, wherein said systematically distributed surface areas are predominately of a low yarn interlacing density; being provided by successive yarns oriented in one of said first and second directions floating over two or more successive yarns oriented in the other of said first and second directions, adjacent systematically distributed surface areas being separated by said lattice.

20. The fabric of claim 1, wherein said systematically distributed surface areas include an area therein wherein one or more of said successive yarns oriented in said one of said first and second directions interlaces with at least one yarn oriented in the other of said first and second directions to thereby interrupt the continuity of the yarn float over the yarns oriented in the other of said first and second directions.

21. The fabric of claim 1, wherein said systematically distributed surface areas include at least four successive yarns oriented in each of said first and second directions.

22. The fabric of claim 1, wherein said systematically distributed surface areas include sixteen successive yarns oriented in each of said first and second directions.

23. The fabric of claim 1, wherein said systematically distributed surface areas include eight successive yarns in one of said first and second directions and seven successive yarns in the other of said first and second directions.

24. The fabric of claim 1, wherein said systematically distributed surface areas include eight successive yarns in one of said first and second directions and eight successive yarns in the other of said first and second directions.

25. A fabric employed in a web forming apparatus to form a patterned fibrous web, said fabric including a web-contacting surface for engaging a fibrous web and assisting in imparting a pattern in said web, said fabric including only a single layer of yarns oriented in first and second directions and being woven to provide systematically distributed surface areas having a predetermined configuration, said systematically distributed surface areas being provided by successive yarns oriented in one of said first and second directions floating over two or more successive yarns oriented in the other of said first and second directions, adjacent systematically distributed surface areas being separated by a region wherein said successive yarns oriented in said one of said first and second directions float under one or more successive yarns oriented in the other of said first and second directions with the ends of said latter floats defining marginal edges of said adjacent systematically distributed areas.

26. The fabric of claim 25 being a forming wire in a wet forming apparatus.

27. The fabric of claim 25 being a through-air drying fabric in a wet forming apparatus.

28. The fabric of claim 25 being a transfer fabric in a wet forming apparatus.

29. The fabric of claim 25 being a forming wire in a dry forming apparatus.

30. The fabric of claim 25 wherein said yarns oriented in said one of said first and second directions are weft yarns and the yarns oriented in the other of said first and second directions are warp yarns.

31. The fabric of claim 25 wherein said systematically distributed surface areas include an area therein wherein one or more of said successive yarns oriented in said one of said first and second directions interlaces with at least one yarn oriented in the other of said first and second directions to thereby interrupt the continuity of the yarn float over the yarns oriented in said other of said first and second directions.

32. The fabric of claim 25 wherein each of said systematically distributed surface regions are provided by at least four successive yarns oriented in each of said first and second directions.

33. The fabric of claim 25 wherein each of said systematically distributed surface areas include sixteen successive yarns oriented in each of said first and second directions.

34. The fabric of claim 25 wherein each of said systematically distributed surface areas include eight successive yarns in one of said first and second directions and seven successive yarns in the other of said first and second directions.

35. The fabric of claim 25 wherein each of said systematically distributed surface include eight successive yarns in one of said first and second directions and eight successive yarns in the other of said first and second directions.

36. A fabric employed in a web forming apparatus to form a patterned fibrous web, said fabric including a web-contacting surface for engaging a fibrous web and assisting in imparting a pattern in said web, said fabric including only a single layer of yarns oriented in first and second directions and being woven to provide systematically distributed areas of a predetermined configuration, said systematicallydistributed areas being provided by successive yarns oriented in the first direction floating over two or more successive yarns oriented in the second direction on the surface of the fabric employed to engage the fibrous web, adjacent systematically distributed regions being separated by a region wherein said successive yarns oriented in said first direction float under one or more successive yarns oriented in said second direction, said one or more successive yarns oriented in said second direction separating said adjacent systematically distributed regions.

37. A fabric employed in a web forming apparatus to form a patterned fibrous web, said fabric including a web-contacting surface for engaging a fibrous web and assisting in imparting a pattern in said web, said fabric including only a single layer of yarns oriented in first and second directions and being woven to provide a lattice arrangement, said lattice arrangement separating a plurality of systematically distributed surface areas of a configuration that is defined by the lattice arrangement; said systematically distributed surface areas including at least three yarns oriented in each of said first and second directions, the lattice arrangement including yarns of said systematically distributed surface areas, those yarns that are in both the lattice arrangement and in said systematically distributed surface areas having an interlacing density in said systematically distributed surface areas that is greater than or equal to the interlacing density in said lattice arrangement.

38. The fabric of claim 34 wherein those yarns that are in both the lattice arrangement and in said systematically distributed surface areas having an interlacing density in said systematically distributed surface areas that is greater than the interlacing density in said lattice arrangement.

* * * * *